US007784477B2

(12) United States Patent
Seasly et al.

(10) Patent No.: US 7,784,477 B2
(45) Date of Patent: Aug. 31, 2010

(54) AUTOMATED NON-CONTACT CLEANING

(75) Inventors: Elaine E. Seasly, Tucson, AZ (US); Zachariah A. Seasly, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 920 days.

(21) Appl. No.: 11/353,545

(22) Filed: Feb. 14, 2006

(65) Prior Publication Data

US 2007/0186961 A1 Aug. 16, 2007

(51) Int. Cl.
*B08B 3/12* (2006.01)
*B08B 3/00* (2006.01)

(52) U.S. Cl. ..... 134/172; 134/95.1; 134/68

(58) Field of Classification Search ..... 134/95.1, 134/103.2, 172, 103.3, 123, 8, 6, 93, 56 R–58 R, 134/66

See application file for complete search history.

(56) References Cited

U.S. PATENT DOCUMENTS

| | | | | |
|---|---|---|---|---|
| 4,806,171 | A | 2/1989 | Whitlock et al. | |
| 5,315,793 | A * | 5/1994 | Peterson et al. | 451/2 |
| 5,806,544 | A * | 9/1998 | Kosic | 134/68 |
| 5,836,809 | A * | 11/1998 | Kosic | 451/89 |
| 5,904,737 | A * | 5/1999 | Preston et al. | 8/158 |
| 6,066,032 | A | 5/2000 | Borden et al. | |
| 6,240,936 | B1 | 6/2001 | DeSimone et al. | |
| 6,257,254 | B1 * | 7/2001 | Rochette et al. | 134/105 |
| 6,530,823 | B1 | 3/2003 | Ahmadi et al. | |
| 6,572,457 | B2 * | 6/2003 | DePalma et al. | 451/89 |
| 6,719,612 | B2 | 4/2004 | Visaisouk et al. | |
| 6,764,385 | B2 | 7/2004 | Boumerzoug et al. | |
| 2004/0221878 | A1 * | 11/2004 | Johnson | 134/56 R |
| 2005/0215445 | A1 | 9/2005 | Boumerzoug et al. | |

OTHER PUBLICATIONS

Richard R. Zito, "Cleaning Large Optics with C02 Snow," SPIE, vol. 1236, Jul. 1990, pp. 952-971.

* cited by examiner

*Primary Examiner*—Michael Kornakov
*Assistant Examiner*—Stephen Ko
(74) *Attorney, Agent, or Firm*—The NOblitt Group, PLLC

(57) ABSTRACT

The disclosed system, device and method for automated non-contact cleaning of hardware articles generally includes: a cleaning chamber configured to at least partially enclose the hardware article to be cleaned; a plurality of nozzles configured to spray a sublimating agent on the hardware article; an air inlet configured to purge the chamber with a gas; and an air outlet configured to exhaust the purge gas, contaminants and sublimating agent from the chamber. Disclosed features and specifications may be variously controlled, adapted or otherwise optionally modified to realize improved non-contact cleaning function.

9 Claims, 3 Drawing Sheets

AUTOMATED NON-CONTACT CLEANING

FIELD OF INVENTION

The present invention generally concerns cleaning systems; and more particularly, representative and exemplary embodiments of the present invention generally relate to systems, devices and methods for automated non-contact cleaning of articles with sublimation agents.

BACKGROUND OF INVENTION

Hardware equipment and other articles often require cleaning during manufacture, prior to transportation or shipment, after use, and prior to cleanroom entry. The purpose of the cleaning process is to remove particulate matter and other contaminants present on the surface of the article in order to prevent contamination of other surfaces in the cleanroom environment.

Solvent wipe and gas blow-off techniques are examples of conventional cleaning processes. For example, a solvent wipe may include physical contact of a low-linting cloth or fiber wipe (e.g., moistened with a solvent such as isopropyl alcohol). For items with complex surface geometries, compressed air or dry nitrogen may be flowed over the surface to blow off contaminants.

Both solvent wipe and gas blow-off techniques have disadvantages with respect to the removal of particulate contaminants. Representatively, since solvent wiping is a contact cleaning method, there is a high risk of damage to sensitive components or delicate surfaces. Gas blow-off techniques generally remove larger particles, but typically will not remove particles smaller than about 2 microns due to boundary layer effects. Additionally, both solvent wipe and gas blow-off are tedious and difficult for operators to perform effectively on large equipment surfaces.

An alternative, non-contact cleaning technique involves the use of carbon dioxide ($CO_2$) snow cleaning. In this method, liquid $CO_2$ is flowed under high pressure through a small orifice positioned to face the item to be cleaned. The resulting pressure differential forces the liquid $CO_2$ to transition from the liquid to the solid phase by operation of Joule-Thompson cooling.

The relationship between temperature, pressure and volume of a gas is generally described by the gas laws. When volume is increased, the gas laws do not uniquely determine what happens to the pressure and temperature of the gas. In general, when a gas expands adiabatically, the temperature may either decrease or increase, depending on the initial temperature and pressure. For a fixed pressure, a gas has a Joule-Thomson (Kelvin) inversion temperature, above which expansion causes the temperature to rise, and below which expansion causes cooling. For most gases, at atmospheric pressure this temperature is fairly high (above room temperature), and so gases may be cooled by expansion.

In accordance with this procedure, $CO_2$ snowflakes may be produced in the 5 micron range for aggressive cleaning as well as up to about 0.5 cm for the cleaning of delicate surfaces. Control of the size of the $CO_2$ snowflakes may be accomplished by varying the flow rate through the nozzle. As $CO_2$ snowflakes impinge on a surface, they transfer momentum to particulate matter. When the $CO_2$ snowflakes sublime, particulate contamination is generally carried away from the surface, thus cleaning the surface.

This form of cleaning is able to achieve a higher level of cleanliness than simply blowing a gas, such as dry air or nitrogen, over a surface. The carbon dioxide flakes are able to penetrate the boundary layer and efficiently remove sub-micron contaminants down to 0.1 microns in size. Since $CO_2$ snowflakes sublime upon impingement on a surface, substantially no residue is left on the surface after cleaning.

The benefits of the $CO_2$ snow cleaning technique are that it is a non-contact method, thereby reducing the risk of damage to sensitive surfaces. Additionally, $CO_2$ snow cleaning removes very small (e.g., sub-micron) contaminants. Moreover, $CO_2$ snow cleaning is appropriate for the removal of light hydrocarbons. For example, a thin layer of liquid $CO_2$, formed at the interfaces between the $CO_2$ snow particle and the surface, may act as a solvent by dissolving organic contaminants and lifting them away from the surface in the flow of $CO_2$ snow and vapor.

Conventional $CO_2$ snow cleaning equipment generally consists of hand-held spray guns with hose attachments to a $CO_2$ liquid source. The operator performing the cleaning must generally hold the spray gun and control the flow of $CO_2$ snow over the surface to be cleaned. For larger pieces of hardware, cleaning with a $CO_2$ snow gun may be difficult, since only a small surface area at a time may typically be cleaned. In these situations, cleaning with a single $CO_2$ snow gun may be time consuming, and it may be difficult to identify which surfaces have already been cleaned and which surfaces have yet to be cleaned.

In another conventional application, $CO_2$ snow cleaning may be performed within a manual glove box. An operator must generally fit gloved hands into the glove box and manually orient the surface of the article to be cleaned with one hand while controlling the $CO_2$ snow gun with the other hand. This reduces the non-contact aspect of $CO_2$ snow cleaning, and is generally not effective for cleaning larger hardware articles and surfaces.

SUMMARY OF THE INVENTION

In various representative aspects, the present invention comprises an automated non-contact cleaning system and method. Exemplary features generally include: a cleaning chamber configured to at least partially enclose the hardware article to be cleaned; a plurality of nozzles configured to spray a sublimating agent on the hardware article; an air inlet configured to purge the chamber with a gas; and an air outlet configured to exhaust the purge gas and sublimating agent from the chamber.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the Detailed Description, wherein:

Figure 1:
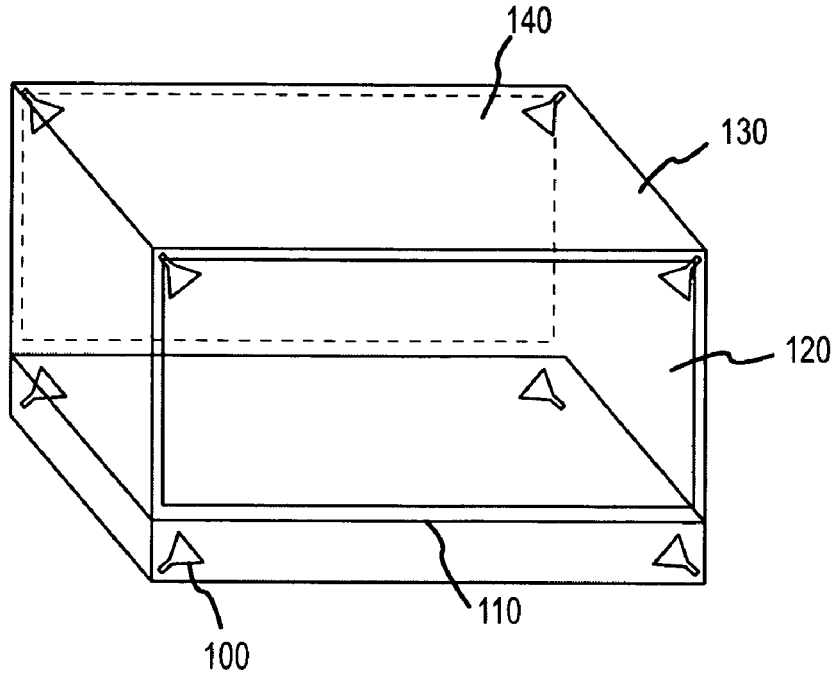
FIG. 1 representatively illustrates a non-contact cleaning chamber in accordance with an exemplary embodiment of the present invention.

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", "forward", "aft", and the like in the Description and/or in the claims, if any, are generally employed for descriptive purposes and not necessarily for comprehensively describing exclusive relative position. Any of the preceding terms so used may be interchanged under appropriate circumstances such that various embodiments of the invention described herein, for example, may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the scope, applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

A detailed description of an exemplary application, namely a method and apparatus for automated non-contact $CO_2$ cleaning of hardware articles, is provided as a specific enabling disclosure that may be generalized to any application of the disclosed system, device and method for automated non-contact cleaning in accordance with various embodiments of the present invention.

An exemplary embodiment of the present invention comprises an automated chamber in which hardware articles to be cleaned may be placed inside a chamber with multiple nozzles providing a shower of $CO_2$ snow. Two representative designs include: a walk-in chamber for cleaning larger articles, and a smaller chamber for use as, for example, a cleanroom pass-through. Both representative designs provide an enclosure for containing the hardware article to be cleaned, the $CO_2$ snow, contaminants and purge gases. The cleaning process may be adapted to comprise a substantially automated process, thereby reducing the potential for human error and eliminating the need for an operator to guide the carbon dioxide snow nozzles.

In the walk-in chamber design, a door may be opened and the hardware article transported into the chamber. The chamber may be located in an anteroom of a cleanroom so that hardware articles entering the cleanroom may be cleaned with $CO_2$ snow and then transferred to the cleanroom via a door on the opposite (e.g., cleanroom) side of the chamber. Fixturing of the hardware article may be provided in order to prevent the article from moving during the cleaning process. Additionally, hardware articles that are sensitive to electrostatic discharge (ESD) may be grounded via a grounding strap.

Once the hardware article is secured, the doors of the chamber may be closed and the cleaning process may commence. The chamber may be initially purged with dry air, nitrogen, and/or the like, which passes through a dehumidifier to remove or otherwise reduce moisture and then a high efficiency particulate air (HEPA) filter to remove or otherwise reduce particulate contaminants before the sublimation agent is introduced to the chamber. This generally ensures that moisture will not condense on the hardware article during the cleaning process. Once the chamber is sufficiently purged, the sublimating agent may then be introduced. For example, liquid $CO_2$ may generally be delivered from a storage source to the nozzle manifold. The liquid $CO_2$ will generally undergo a phase change to the solid state at the orifice of each nozzle. The hardware article to be cleaned may then be sprayed with the $CO_2$ snow. The hardware article may also be rotated on a rotary table or may remain stationary while the $CO_2$ manifold arm rotates around the hardware article to ensure thorough cleaning.

The $CO_2$ snow cleaning process should generally take only a few minutes to sufficiently cover the hardware article. Once cleaning is complete, the liquid $CO_2$ supply valve may be closed and the $CO_2$ snow shower stops. The HEPA filtered dry air or nitrogen may then be introduced to the chamber again to purge $CO_2$ and contaminants out of the chamber. $CO_2$ and exhaust gases will generally flow down through the grated floor of the chamber and may then be vented to a safe location. The cleaned hardware article may thereafter safely enter the cleanroom environment.

Smaller objects are typically admitted to a cleanroom environment via a pass-through. The pass-through may be fixed in the wall of a cleanroom and generally be configured with a door on the cleanroom side and a door on the opposite side to the non-cleanroom environment. A representative pass-through chamber design, in accordance with exemplary aspects of the present invention, generally allows for easy cleaning of the hardware article before entering the cleanroom. The door to the pass-through on the non-cleanroom side may be opened and the hardware article to be cleaned may be placed on, for example, a grate rack. Fixturing of the hardware article may be performed in order to prevent the hardware article from moving during the cleaning process. Articles that are sensitive to ESD may be grounded via a grounding strap. Once the door is closed, the chamber environment may be purged with HEPA filtered dry air or nitrogen, as generally described vide supra. Multiple nozzles present in the pass-through may be configured to spray the hardware article with $CO_2$ snow, so that substantially all sides of the hardware article are cleaned. After the $CO_2$ snow cleaning process is complete, the pass-through chamber may be flushed with HEPA filtered dry air or nitrogen, and the gases may then be exhausted to a safe location. The pass-through door on the cleanroom side may then be opened to withdraw the hardware article and admit it to the cleanroom.

Representatively disclosed designs may be suitably adapted to clean hardware articles with $CO_2$ snow at intermediate points during manufacturing processes as well, and as a final cleaning step for hardware to be packaged for transport or final shipment. For example, hardware articles in a cleanroom environment that become contaminated with particles may be placed in the pass-through to undergo a $CO_2$ snow cleaning without removing the hardware from the cleanroom environment.

As representatively depicted in FIG. 1, chamber 130 may comprise a cleanroom pass-through. Chamber 130 generally has doors on each side (e.g., front access door 120 and rear access door 140) of the pass-through. A plurality of $CO_2$ snow nozzles 100 may be disposed within chamber 130; the number and locations of which may at least partially be determined by the size and shape of the chamber as well as the type and configuration of hardware articles to be cleaned. Grate floor 110 may be used with nozzles underneath in order to clean the bottom side of the hardware article. In an exemplary embodiment, grate floor 110 may be removable to allow for maintenance and cleaning.

Figure 2:
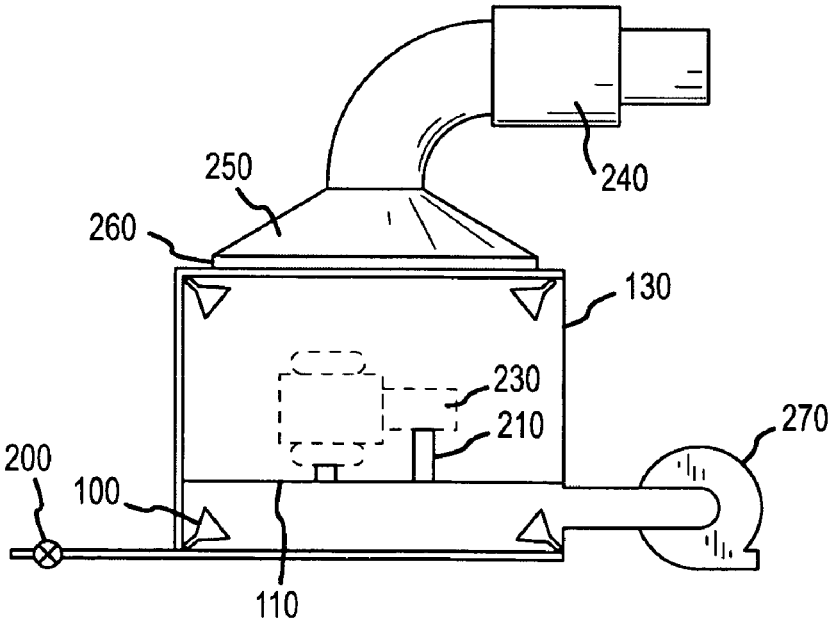
FIG. 2 representatively illustrates an automated non-contact cleaning system in accordance with an exemplary embodiment of the present invention.

A non-contact cleaning system utilizing the chamber 130 generally depicted in FIG. 1, in accordance with an exemplary embodiment of the present invention, is representatively illustrated in FIG. 2. Chamber 130 may comprise an enclosure of arbitrary size and/or shape. The enclosure may be constructed of rigid materials, such as polycarbonate and/or the like, or of a rigid frame covered with a film such as polyethylene. Utilization of an at least partially transparent material in the construction of the enclosure will generally aide the observation of the cleaning process, but is not a required feature or element of the present invention.

Clean air (and/or an inert gas; such as nitrogen, argon, krypton, etc.) may be introduced to chamber 130 through diffuser 250 and HEPA filter 260 in the ceiling or upper wall of the chamber. Dehumidifier 240 may be optionally included in the system to dry the incoming air in order to eliminate or otherwise reduce condensation of moisture on the hardware article 230 prior to and during the cleaning process. Air may be exhausted through a duct disposed, for example, near the floor of chamber 130 or under grate false floor 110. Blower 270 may be suitably configured inline with the air intake or exhaust to provide air handling. In the case of a $CO_2$ snow chamber system, the exhaust may be ducted to a safe location to eliminate or otherwise reduce the possibility of ambient carbon dioxide concentrations accumulating to dangerous levels. In addition to carbon dioxide, various other sublimating agents, whether now known or otherwise hereafter described in the art, may be alternatively, conjunctively or sequentially employed in order to achieve a substantially similar result.

Hardware article 230 may be optionally configured with fixture standoffs 210 (e.g., support elements) in order to suitably orient hardware article 230 with respect to nozzles 100 as well as to substantially immobilized hardware article 230 during the cleaning process. Accordingly, it will be appreciated that hardware fixturing may be employed in order to render the cleaning process more effective and/or to prevent damage to the article 230 being cleaned.

Controlled introduction of liquid sublimation agent (e.g., $CO_2$) may be accomplished via valve 200. Valve 200 may be actuated via manual, mechanical and/or electronic control(s). The system may be optionally configured with safety interlocks in order to prevent, for example, activation of $CO_2$ snow production while doors 120, 140 to chamber 130 are open.

Chamber 130 may comprise a substantially permanent installation, may be semi-permanent (such as in the case of a folding structure), or may be suitably configured as a mobile assembly with, for example: wheels; skids; hoist rings; and/or the like. It will be appreciated that various other structural features and/or elements, whether now known or otherwise hereafter described in the art, may be alternatively, conjunctively or sequentially employed to produce a substantially similar result. The same modifications are to be understood as falling within the scope of the present invention.

Figure 3:
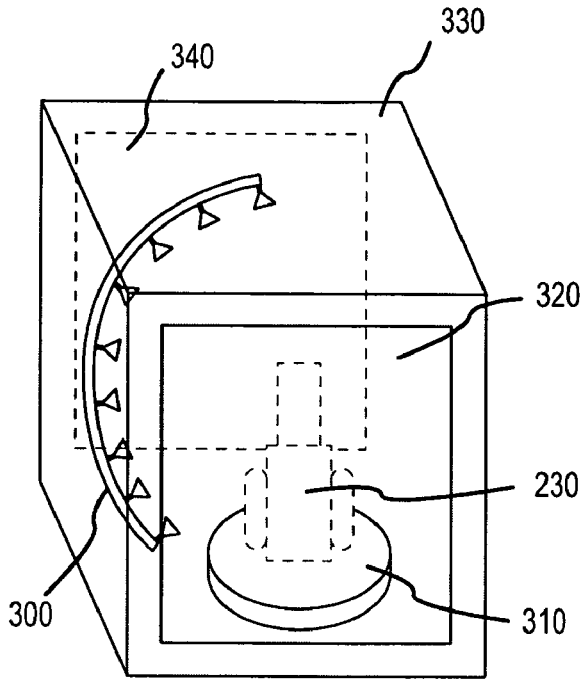
FIG. 3 representatively illustrates a non-contact cleaning chamber in accordance with another exemplary embodiment of the present invention.

As representatively illustrated in FIG. 3, chamber 330 may comprise a rotary table design. Chamber 330 generally may be configured with doors on each side (e.g., front access door 320 and rear access door 340) of the enclosure in order to facilitate the transference of hardware articles from one room to another after cleaning. It will be appreciated, however, that more doors may be added as needed.

A plurality of $CO_2$ snow nozzles 300 may be disposed within chamber 330; the number and locations of which may at least partially be determined by the size and shape of the chamber as well as the type and configuration of hardware articles to be cleaned. Chamber 330 may also be configured with a motorized rotary turn-table 310, which may be actuated in order to rotate hardware article 230 during cleaning. As hardware article 230 is rotated, substantially every surface of article 230 may be exposed to the sublimating agent introduced through nozzles 300 in order to affect non-contact cleaning of hardware article 230.

Figure 4:
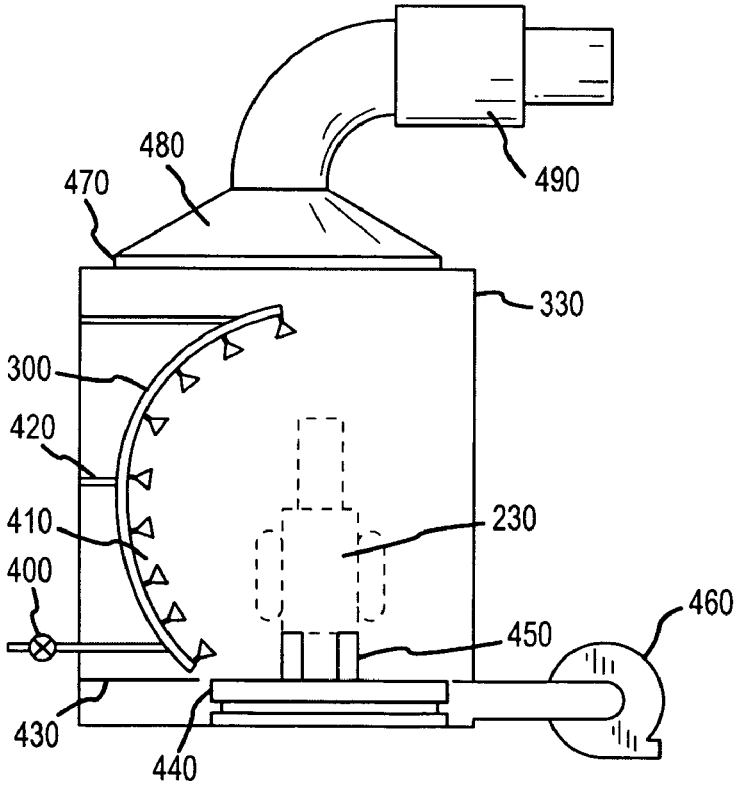
FIG. 4 representatively illustrates another automated non-contact cleaning system in accordance with an exemplary embodiment of the present invention.

A non-contact cleaning system utilizing the chamber 330 generally depicted in FIG. 3, in accordance with another exemplary embodiment of the present invention, is representatively illustrated in FIG. 4. Chamber 330 may comprise an enclosure of arbitrary size and/or shape. The enclosure may be constructed of rigid materials, such as polycarbonate and/or the like, or of a rigid frame covered with a film such as polyethylene. Utilization of an at least partially transparent material in the construction of the enclosure will generally aide the observation of the cleaning process, but is not a required feature or essential element of the present invention.

Clean air (and/or an inert gas; such as nitrogen, argon, krypton, etc.) may be introduced to chamber 330 through diffuser 480 and HEPA filter 470 in the ceiling or upper wall of chamber 330. Dehumidifier 490 may be optionally included in the system to dry the incoming air in order to eliminate or otherwise reduce condensation on hardware article 230 prior to and during the cleaning process. Air may be exhausted through a duct disposed, for example, near the floor of chamber 330 or under grate false floor 430. Blower 460 may be suitably configured inline with the air intake or exhaust to provide air handling. In the case of a $CO_2$ snow chamber system, the exhaust may be ducted to a safe location to eliminate or otherwise reduce the possibility of ambient carbon dioxide concentrations accumulating to dangerous levels. In addition to carbon dioxide, various other sublimating agents, whether now known or otherwise hereafter described in the art, may be alternatively, conjunctively or sequentially employed in order to achieve a substantially similar result. For example, krypton may also be used as a sublimating agent.

Nozzle manifold 300 may comprise a curved arc of individual nozzles 410 oriented with respect to hardware article 230 so as to deliver sublimating agent to substantially every surface of the article to be cleaned. Nozzle manifold 300 may be supported by a manifold support 420 in order to substantially fix the disposition of nozzle manifold 300 with respect to the hardware article 230 to be cleaned.

False floor 430 may be of a grate-type material suitably configured to facilitate substantially unobstructed airflow within chamber 330. False floor 430 may also comprise ramps which may be used to transport hardware articles 230 into and out of chamber 330. False floor 430 may also be removable in order to facilitate maintenance and cleaning.

Hardware article 230 may be optionally configured with fixture standoffs 450 (e.g., support elements) in order to suitably orient hardware article 230 with respect to nozzles 300 as well as to substantially immobilized hardware article 230 during the cleaning process. Accordingly, it will be appreciated that hardware fixturing may be employed in order to render the cleaning process more effective and/or to prevent damage to the article 230 being cleaned.

Controlled introduction of liquid sublimation agent(s) (e.g., $CO_2$, krypton, etc.) may be accomplished via valve 400. Valve 400 may be actuated via manual, mechanical and/or electronic control(s). The system may be optionally configured with safety interlocks in order to prevent, for example, activation of $CO_2$ snow production while doors 320, 340 to chamber 330 are open.

Chamber 330 may comprise a substantially permanent installation, may be semi-permanent (such as in the case of a folding structure), or may be suitably configured as a mobile assembly with, for example: wheels; skids; hoist rings; and/or the like. It will be appreciated that various other structural features and/or elements, whether now known or otherwise hereafter described in the art, may be alternatively, conjunctively or sequentially employed to produce a substantially similar result. The same modifications are to be understood as falling within the scope of the present invention.

Figure 5:
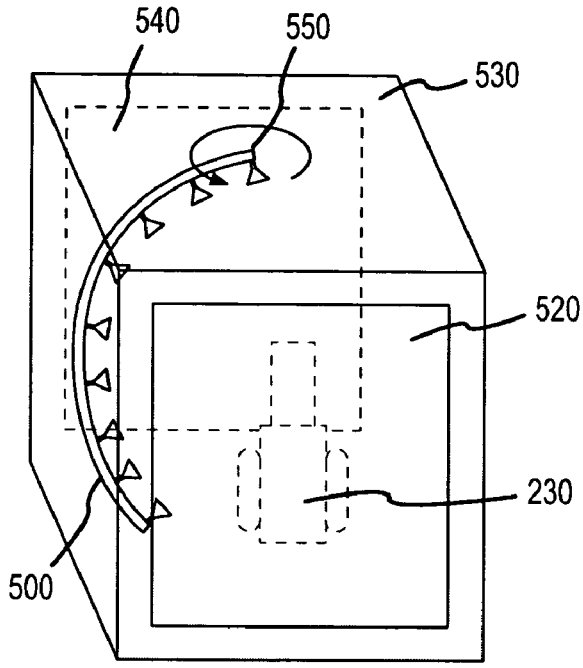
FIG. 5 representatively illustrates a non-contact cleaning chamber in accordance with yet another exemplary embodiment of the present invention.

As representatively illustrated in FIG. 5, chamber 530 may comprise a rotary manifold articulation mechanism 550 suitably configured to allow nozzle manifold 500 to be rotated about a region of chamber 530. Chamber 530 generally may be configured with doors on each side (e.g., front access door 520 and rear access door 540) of the enclosure in order to facilitate the transference of hardware from one room to another after cleaning. It will be appreciated, however, that more doors may be added as needed.

A plurality of $CO_2$ snow nozzles may be disposed on a curved arc manifold 500 within chamber 530; the number and locations of which may at least partially be determined by the size and shape of the chamber as well as the type and configuration of hardware articles to be cleaned. As rotary manifold articulation mechanism 550 is rotated, substantially every surface of article 230 may be consequently exposed to the sublimating agent introduced through nozzles 500 in order to affect non-contact cleaning of hardware article 230.

Figure 6:
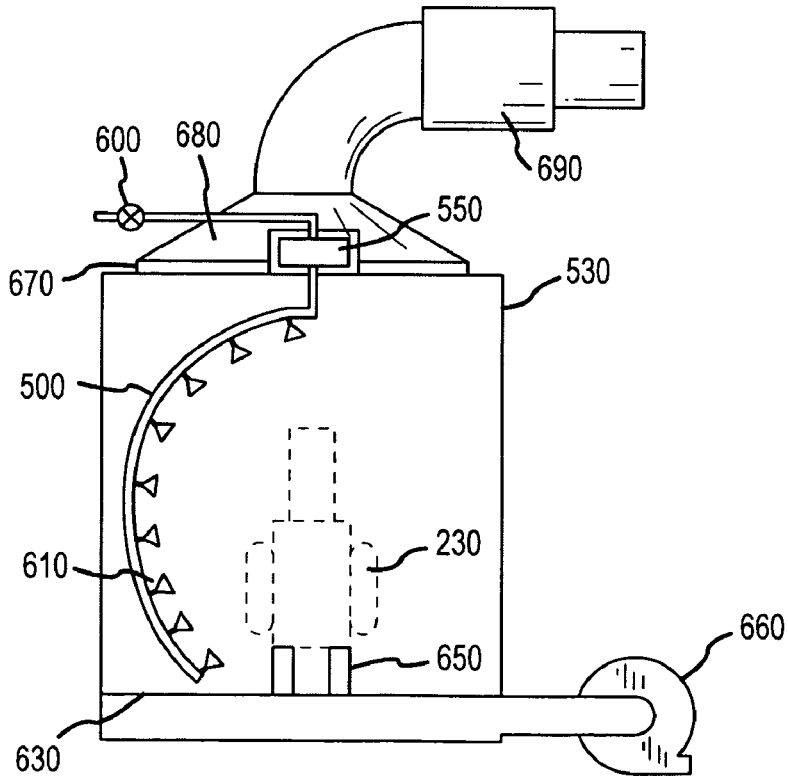
FIG. 6 representatively illustrates yet another automated non-contact cleaning system in accordance with an exemplary embodiment of the present invention.

A non-contact cleaning system utilizing the chamber 530 generally depicted in FIG. 5, in accordance with another exemplary embodiment of the present invention, is representatively illustrated in FIG. 6. Chamber 530 may comprise an enclosure of arbitrary size and/or shape. The enclosure may be constructed of rigid materials, such as polycarbonate and/or the like, or of a rigid frame covered with a film such as polyethylene. Utilization of an at least partially transparent material in the construction of the enclosure will generally aide the observation of the cleaning process, but is not a required feature or essential element of the present invention.

Clean air (and/or an inert gas; such as nitrogen, argon, krypton, etc.) may be introduced to chamber 530 through diffuser 680 and HEPA filter 670 in the ceiling or upper wall of chamber 530. Dehumidifier 690 may be optionally included in the system to dry the incoming air in order to eliminate or otherwise reduce condensation on hardware article 230 prior to and during the cleaning process. Air may be exhausted through a duct disposed, for example, near the floor of chamber 530 or under grate false floor 630. Blower 660 may be suitably configured inline with the air intake or exhaust to provide air handling. In the case of a $CO_2$ snow chamber system, the exhaust may be ducted to a safe location to eliminate or otherwise reduce the possibility of ambient carbon dioxide concentrations accumulating to dangerous levels. In addition to carbon dioxide, various other sublimating agents, whether now known or otherwise hereafter described in the art, may be alternatively, conjunctively or sequentially employed in order to achieve a substantially similar result. For example, krypton may also be used as a sublimating agent.

Nozzle manifold 500 may comprise a curved arc of individual nozzles 610 oriented with respect to hardware article 230 so as to deliver sublimating agent to substantially every surface of the article to be cleaned upon rotation of nozzle manifold 500. Nozzle manifold 500 may be supported by an articulated manifold support mechanism 550 suitably adapted to permit nozzle manifold 500 to be rotated about the hardware article 230 to be cleaned.

False floor 630 may be of a grate-type material suitably configured to facilitate substantially unobstructed airflow within chamber 530. False floor 630 may also comprise ramps which may be used to transport hardware articles 230 into and out of chamber 530. False floor 630 may be removable in order to facilitate maintenance and cleaning.

Hardware article 230 may be optionally configured with fixture standoffs 650 (e.g., support elements) in order to suitably orient hardware article 230 with respect to nozzles 500 as well as to substantially immobilized hardware article 230 during the cleaning process. Accordingly, it will be appreciated that hardware fixturing may be employed in order to render the cleaning process more effective and/or to prevent damage to the article 230 being cleaned.

Controlled introduction of liquid sublimation agent(s) (e.g., $CO_2$, krypton, etc.) may be accomplished via valve 600. Valve 600 may be actuated via manual, mechanical and/or electronic control(s). The system may be optionally configured with safety interlocks in order to prevent, for example, activation of $CO_2$ snow production while doors 520, 540 to chamber 530 are open.

Chamber 530 may comprise a substantially permanent installation, may be semi-permanent (such as in the case of a folding structure), or may be suitably configured as a mobile assembly with, for example: wheels; skids; hoist rings; and/or the like. It will be appreciated that various other structural features and/or elements, whether now known or otherwise hereafter described in the art, may be alternatively, conjunctively or sequentially employed to produce a substantially similar result. The same modifications are to be understood as falling within the scope of the present invention.

In the foregoing specification, the invention has been described with reference to specific exemplary embodiments; however, it will be appreciated that various modifications and changes may be made without departing from the scope of the present invention as set forth in the claims below. The specification and Figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprising", "having", "including" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

What is claimed is:

1. An automated system for precision cleaning of hardware articles, said system comprising:

a walk-in cleaning chamber configured to at least partially enclose a hardware to be cleaned;

a plurality or nozzles disposed within said chamber and upon an armature assembly configured to rotate about an axis such that a rotation circumscribes 360 degrees about said axis and said hardware article, said nozzles suitably configured to spray a sublimating agent upon said hardware article and to impart a substantially spherical impingement or said sublimating agent upon said hardware article to be cleaned;

a gas inlet connected to a gas source and configured to purge said chamber with said gas; and a gas outlet configured to exhaust at least one or said purge gas, contaminants and sublimating agent from the chamber.

2. Tile automated system of claim 1, wherein:

said sublimating agent comprises at least one of carbon dioxide and krypton; and said purge gas comprises at least one of dry air and nitrogen.

3. The automated system of claim 1 further comprising at least one of a safety interlock, a door, a false floor, a grate, a rotary arm, a valve, a nozzle manifold, a ramp, a wheel, a rack, a mounting fixture, a securing fixture and a grounding strap.

4. The automated system of claim 3, wherein at least one of said false floor and said grate are disposed at least above said gas outlet.

5. The automated system of claim 3, wherein said sublimating agent is introduced into said chamber through at least one nozzle via actuation of at least one valve.

6. The automated system of claim 1, wherein introduction of said sublimating agent to said chamber is controlled at least one of manually, remotely and via timer.

7. The automated system of claim 1, wherein said gas inlet further comprises at least one of a diffuser, a HEPA filter and a dehumidifier.

8. The automated system of claim 1, wherein said chamber is suitably configured to comprise at least one of a permanent structural assembly, a semi-permanent structural assembly, a mobile assembly, and a pass through chamber.

9. The automated system claim 1, wherein said gas outlet further comprises at least one of a gas blower and an exhaust duct.

* * * * *